United States Patent [19]

Holman

[11] Patent Number: 4,747,497

[45] Date of Patent: May 31, 1988

[54] TAMPER DETECTION CAP

[76] Inventor: Tommy E. Holman, 8974 Marlow St., Shreveport, La. 71118

[21] Appl. No.: 47,110

[22] Filed: May 8, 1987

[51] Int. Cl.[4] ..... B65D 41/04

[52] U.S. Cl. ..... 215/230; 215/271

[58] Field of Search ..... 215/230, 260, 270, 262, 215/271

[56] References Cited

U.S. PATENT DOCUMENTS

| | | | |
|---|---|---|---|
| 2,040,798 | 5/1936 | Schoonmaker | 215/271 |
| 3,189,210 | 6/1965 | Heisler | 215/260 |
| 4,616,761 | 10/1986 | Nolan | 215/271 |
| 4,673,096 | 6/1987 | Town et al. | 215/230 |

*Primary Examiner*—Donald F. Norton

*Attorney, Agent, or Firm*—John M. Harrison

[57] ABSTRACT

A tamper detector cap which is characterized by an internally-threaded inner cap adapted to thread on the neck of a bottle, jar or other container and provided with a flexible diaphragm and spaced wall grooves located in the outer circumference thereof. An outer cap fitted with a transport window and internal, spaced retainer thread segments for threadibly engaging the wall grooves in the inner cap, is also provided. When the inner cap is threadibly attached to the neck of the container and a vacuum is created in the container, the diaphragm is depressed inwardly and the outer cap is threadibly secured to the inner cap by means of the retainer thread segments and cooperating wall grooves, such that the outer cap is sealed on the inner cap. Application of a counterclockwise torque to the outer cap first loosens the outer cap on the inner cap and then loosens the inner cap and breaks the seal between the inner cap and the threaded neck of the container, causing the diaphragm to assume a neutral position. Alternatively, a positive external pressure can be applied to the container, either before or after the inner cap is threadibly attached to the container neck, in order to deflect the diaphragm inwardly and the outer cap is sealed on the inner cap by operation of the retainer thread segments and wall grooves. When the outer cap is loosened with respect to the inner cap, the seal between the top of the outer cap and the diaphragm is broken and the diaphragm assumes a neutral position adjacent the top of the inner cap, to indicate tampering.

17 Claims, 1 Drawing Sheet

TAMPER DETECTION CAP

BACKGROUND OF THE INVENTION

1. Field of the Invention

This invention relates to a device for indicating tampering with a jar, bottle or other container and more particularly, to a two-piece tamper detection cap which is designed to indicate tampering when a seal is broken, either within the elements of the cap itself, or between the cap and the container. Various bottles, jars and containers of drugs and medicine which are taken orally require extreme care in preparation. If the drug or medicine becomes contaminated during manufacturing, shipping, or storage, then a person or persons who ingest the drugs or medicine can be made seriously ill or may even die as a result of the contamination. Furthermore, in recent years, deliberate contamination of the contents of plastic and glass drug bottles, jars and containers has been effected with poisons such as cyanide, arsenic and the like. Accordingly, many efforts have been made to provide tamper detection mechanisms for determining when a jar, bottle or other plastic or glass container has been previously opened, before placing the container on the shelf for disposition to the public. Many of these tamper detection techniques include the use of one or more seals which can be visually inspected at the time of purchase, to determine whether or not the seal or seals have been broken or tampering has occurred.

The tamper detection cap of this invention affords two-fold protection and is characterized by an inner cap which is provided with internal threads for threadible attachment to the neck of the bottle, jar or other threaded-cap container which contains drugs or medicine. The outside surface of the inner cap is provided with angled or skewed and circumferentially-spaced wall grooves, for receiving cooperating circumferentially-spaced and angled or skewed retainer thread segments which are shorter than the grooves and project inwardly from an outer cap which is designed to deploy on the inner cap. The inner cap is further fitted with a flexible diaphragm across the top thereof and the outer cap is provided with a transparent top or window, wherein the position of the diaphragm can be viewed through the window of the outer cap to determine whether the seal between the inner cap and outer cap or between the inner cap and the container, has been broken. When the inner cap is threaded on the neck of a container which has been previously heated or otherwise evacuated and the drug contents are vacuum sealed therein, the diaphragm is forced downwardly toward the interior of the container from a neutral position. The outer cap is then placed on the inner cap in sealed relationship, such that removal of the inner cap must be undertaken by grasping the outer cap, loosening the outer cap on the inner cap and threadibly removing the outer cap and the inner cap in combination. This action first breaks the seal between the inner cap and the outer cap and then between the inner cap and the container and allows the diaphragm to move upwardly in close proximity to the transparent plastic top of the outer cap, responsive to pressure equalization between the outer cap and the inner cap or between the inner cap and the container. The neutral position of the diaphragm indicates that the outer cap has been loosened on the inner cap or that the inner cap has either been removed or loosened and thereby provides an indication of tampering. In order to provide an indication of tampering responsive to loosening of the outer cap on the inner cap, the inner cap can be initially threaded on the container neck and a positive pressure greater than atmospheric pressure then applied to the container and inner cap to deflect the diaphragm inwardly. The outer cap can then be tightened on the inner cap in sealed relationship and subsequent loosening of the outer cap with respect to the inner cap equalizes the pressure in the space between the outer cap and the inner cap and causes the diaphragm to assume a neutral position, to indicate tampering.

2. Description of the Prior Art

An early patent which details the sealing of a fruit jar is U.S. Pat. No. 225,752, dated Mar. 23, 1880, entitled "Fruit-Jar", to E. Griswold, et al. This patent discloses a cap for fruit jars and a rim capable of attachment to the jar, a foraminated plate surrounded by the rim and securely attached to the rim and a flexible diaphragm arranged such that when the diaphragm is forced inwardly by the pressure of the atmosphere as a vacuum is maintained within the jar, then the plate will support and sustain the diaphragm. Under these circumstances, the plate and diaphragm combination will permit the passage of any gases that may be evolved within the jar, which gases will act upon the inside of the diaphragm and lift the diaphragm to indicate the presence and progress of decomposition in the contents of the jar. U.S. Pat. No. 2,449,014, dated Sept. 7, 1948, to S. Shaffer, discloses a "Container Closure". The container closure detailed in this patent includes a threaded cap designed to tighten on the threaded neck of a mason jar, with a bendible lid provided beneath the mason jar cap. The lid is tightened on the jar by operation of the cap, with the center of the lid disposed in concave relationship with respect to the contents of the jar, such that internal pressure generated by gases from decomposition of the contents will cause the lid to expand upwardly to indicate such decomposition. A "Vacuum-Indicating Two-Part Tamperproof Closure and Combination" is disclosed in U.S. Pat. No. 3,443,711, dated May 13, 1969, to D. W. Olson. This patent details a container closure having a primary cap seal and a secondary cap overlying the primary cap seal. Both caps independently seal a container, with an evacuated space between the two caps provided, so that a leak at either the primary cap seal or the overcap will deflect the top of the overcap upwardly, providing a visual indication of leakage. U.S. Pat. No. 3,836,033, dated Sept. 17, 1974, to Armando Podesta, discloses a "Closure Cap". The closure cap is characterized by a cap base extending over the container mouth and beyond its outer edge and a separate encircling cap skirt secured to the container by a screw or bayonet connection and engaging the edge of the cap base. The cap base is orginally curved inwardly, but is forced into an outward curve by the anchoring forces acting on its edge when the skirt is secured over it. The cap base is again subsequently curved inwardly by reduced pressure formed in the container. Pressure is thus indicated by a return to the outwardly curved condition. Reusable closures for hermetically sealing containers are disclosed in U.S. Pat. No. 4,122,964, dated Oct. 31, 1978, to Neal R. Morris. Disclosed is a semi-rigid, deflectable, reusable lid in the shape of a disc and formed of a non-porous material which is adapted to hermetically seal the open mouth of a container. The lid is positioned over the mouth of the container to be sealed and is retained in position by a threaded band. The inner lid surface lying adjacent the perimeter of the lid is elastomeric or pliable in construction and is adapted to be depressed by the rim of the container during the cooling interval of the usual food processing cycle, to provide a seal between the inner surface of the lid and the rim of the container. When the container is sealed, the central portion of the lid is drawn partially upwardly into the open mouth by the reduced pressure within the container.

It is an object of this invention to provide a new and improved tamper detection cap which is characterized by an inner cap that is threadibly secured to the neck of a bottle, jar or other container containing drugs or other medicine and an outer cap which fits over the inner cap in limited motion, threadible relationship, such that the inner cap cannot be removed without grasping, loosening and removing the outer cap with the inner cap. A diaphragm is provided in the inner cap and the outer cap includes a transparent top or window, such that the diaphragm can be viewed through the window in the outer cap to determine whether or not the seal has been broken and the diaphragm deflected, to indicate tampering.

Another object of this invention is to provide a new and improved tamper detection cap which includes an inner cap provided with a diaphragm and internal threads for threadibly fitting on the threaded neck of a plastic or glass bottle or jar, such that the diaphragm is deflected inwardly responsive to heating or vacuum sealing of the bottle or jar or application of a positive pressure greater than atmospheric on the bottle or jar and the inner cap. An outer cap is designed to threadibly seat on the inner cap and is provided with a transparent window, through which the diaphragm can be viewed, such that the inner cap cannot be removed from the bottle or jar without removing the outer cap, which action first loosens the outer cap on the inner cap and loosens the inner cap on the bottle or jar and causes the diaphragm to move upwardly, responsive to loss of pressure between the outer cap and the inner cap or vacuum in the bottle or jar.

Still another object of this invention is to provide a tamper detection cap which includes an inner cap provided a flexible diaphragm and with threads for threadible attachment to a glass or plastic bottle, jar or container, such that the inner cap can be threadibly and hermetically sealed on the container or subjected to a pressure greater than atmospheric pressure, to cause the diaphragm to deflect downwardly. An outer cap fits over the inner cap and is provided with spaced, skewed, internal retainer thread segments for engaging cooperating spaced, skewed, external wall grooves provided in the inner cap, such that the inner cap cannot be removed from the bottle or jar without grasping the outer cap and twisting the outer cap in a counterclockwise direction. This action first loosens the outer cap on the inner cap and equalizes the pressure between the outer cap and inner cap, if a positive pressure was previously applied to the inner cap during packaging. Further loosening of the outer cap causes unthreading of the inner cap and loss of any vacuum which may have been induced in the container, to deflect the diaphragm when the inner cap is loosened on the neck threads of the container.

SUMMARY OF THE INVENTION

These and other objects of the invention are provided in a new and improved tamper detection cap which is characterized by an inner cap having a threaded interior for threadible attachment to the neck of a glass or plastic bottle, jar or other container and a flexible diaphragm spanning the top of the inner cap, such that the inner cap can be threadibly attached to the neck of the container and the diaphragm depressed inwardly when the container is hermetically sealed or when a positive pressure greater than atmospheric is applied to the exterior of the container and the inner cap, or to the inner cap itself. An outer cap is provided with a transparent top and internal spaced and skewed thread segments for engaging longer external, spaced and skewed grooves provided in the inner cap, such that the inner cap cannot be removed from the container without grasping and twisting the outer cap in a counterclockwise direction. When this is accomplished, the outer cap is first loosened on the inner cap responsive to traversal of the thread segments in the grooves, and any positive air pressure which may be exerted on the diaphragm during packaging is equalized, allowing the diaphragm to neutralize. Further counterclockwise twisting of the outer cap then loosens the inner cap on the container threads, to eliminate any vacuum which may be created in the container and causes the diaphragm to move into a neutral position, which position can be viewed through the transparent window of the outer cap, to indicate tampering.

BRIEF DESCRIPTION OF THE DRAWING

The invention will be better understood by reference to the accompanying drawing, wherein.

DESCRIPTION OF THE PREFERRED EMBODIMENTS

Figure 1:
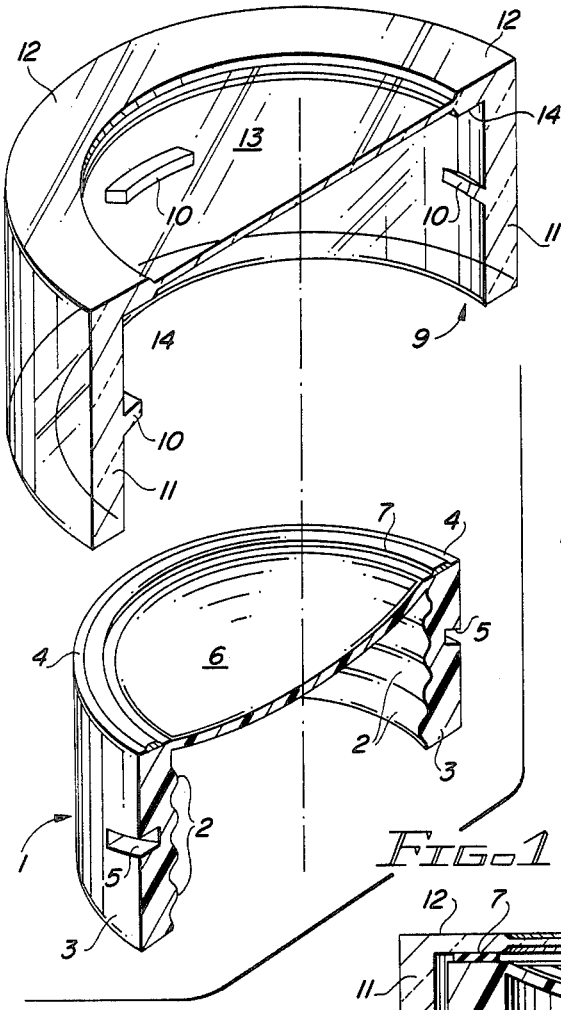
FIG. 1 is an exploded, sectional view of a preferred embodiment of the tamper detection cap of this invention.

Referring initially to FIG. 1 of the drawings, the tamper detection cap of this invention is generally characterized by an inner cap 1 and an outer cap 9, which inner cap 1 is designed for enclosure inside the outer cap 9. The inner cap 1 is further characterized by internal neck threads 2, provided in an inner cap wall 3, with a round diaphragm face 4 disposed in the top surface of the inner cap wall 3, as illustrated. A circular seal 7, which is constructed of a suitable plastic or rubber material, is provided on the inner cap wall 3 and a flexible diaphragm 6, also constructed of a suitable flexible plastic material or rubber, spans the top of the inner cap wall 3 and is attached to the inner cap wall 3 at the diaphragm face 4 inside the seal 7. Multiple slanted or skewed wall grooves 5 are provided in circumferentially spaced, angular relationship in the inner cap wall 3. The outer cap 9 is designed to fit entirely over the inner cap 1 and is characterized by an outer cap wall 11, fitted with angularly disposed, inwardly-extending, skewed or slanted retainer thread segments 10, which are provided in circumferentially spaced relationship in the outer cap wall 11. The retainer thread segments 10 are designed to slidably engage the longer wall grooves 5 in the inner cap 1 to selectively loosen and tighten the outer cap 9 on the inner cap 1 throughout a short range of motion, in limited threaded relationship. A smooth wall face 12 is provided in the top portion of the outer cap wall 11 and receives an outer cap window 13, which is constructed of a transparent plastic material, such as a polycarbonate material. An interior wall shoulder 14 is built into the outer cap wall 11 and is designed to fit tightly against the seal 7 in the inner cap 1, when the outer cap 9 is placed over the inner cap 1 and the retainer thread segments 10 engage the wall grooves 5, as hereinafter further described. A seal space 8 is created between the diaphragm 6 and the outer cap window 13 when the outer cap 9 is fitted on the inner cap 1, as illustrated in FIGS. 2 and 4.

Figure 3:
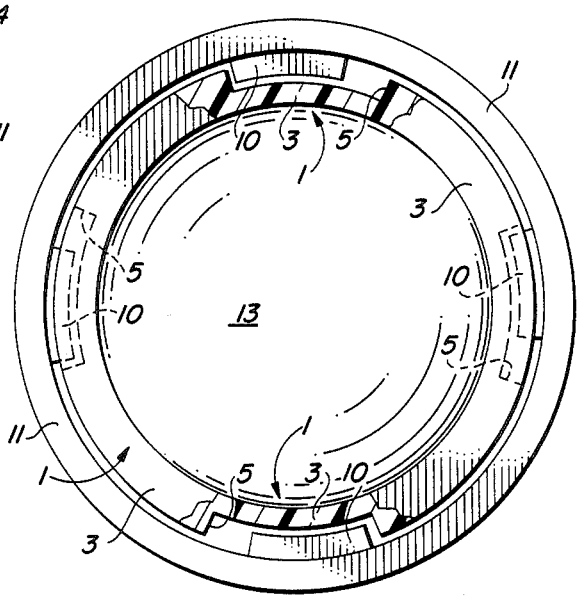
FIG. 3 is a sectional view taken along line 3—3 of the inner cap and outer cap illustrated in FIG. 2.
Figure 2:
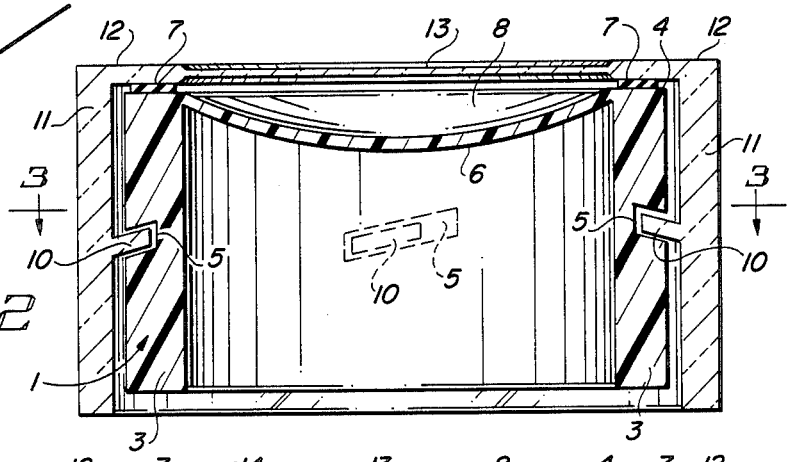
FIG. 2 is a sectional view of the inner cap and outer cap illustrated in FIG. 1 in sealing configuration.
Figure 4:
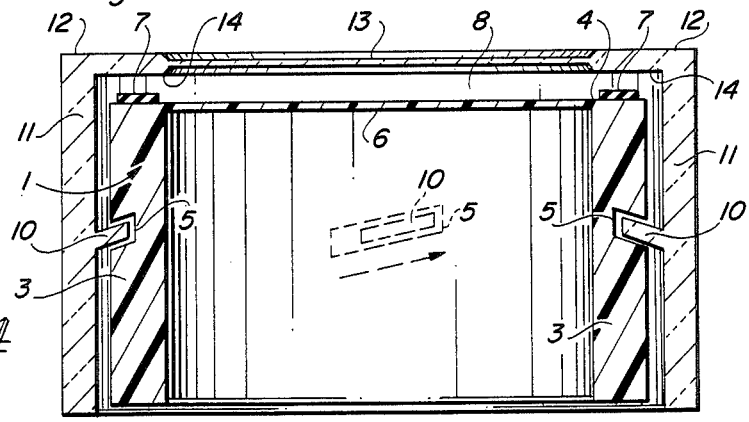
FIG. 4 is a sectional view of the inner cap and outer cap illustrated in FIG. 2, with the outer cap displaced from the inner cap in non-sealing configuration.

Referring now to FIGS. 2–4 of the drawings, when the outer cap 9 is placed over the inner cap 1 with the retainer thread segments 10 tightly engaging the ends of the companion wall grooves 5, then the wall shoulder 14 is pressed against the seal 7, as illustrated in FIG. 2, to define the seal space 8 as the outer cap 9 is rotated fully in the clockwise direction with respect to the inner cap 1. Furthermore, since the respective wall grooves 5 are longer than the companion retainer thread segments 10, reverse rotation of the outer cap 9 with respect to the inner cap 1 in the counterclockwise direction causes the retainer thread segments 10 to traverse the wall grooves 5, engage the opposite ends of the wall grooves 5 and raise the wall shoulder 14 a short distance from the seal 7, to increase the size of, and break any pressure seal which may be provided in, the space 8, as illustrated in FIG. 4. Additional counterclockwise rotation of the outer cap 9 causes the neck threads 2, provided in the inner cap wall 3 of the inner cap 1, to loosen on the neck of a companion jar, bottle, or container (not illustrated), such that the inner cap 1 and the outer cap 9 can be removed in concert from the container.

In operation, and referring again to the drawing, when it is desired to seal the contents of a jar, bottle or other container (not illustrated) using the tamper detection cap of this invention, in a first preferred embodiment of the invention, the inner cap 1 is first tightly and threadibly inserted on the threaded neck of the container by threadibly engaging the neck threads 2 with the threads on the bottle or jar in conventional fashion. The container is then heated or otherwise hermetically and vacuum-sealed according to techniques which are well known to those skilled in the art, in order to create a vacuum inside the container and cause the diaphragm 6 to deploy downwardly from a neutral position, as illustrated in FIG. 2, when the container cools or the vacuum-creating technique is completed. The container contents are then sealed, with the inner cap 1 tightly and threadibly attached to the neck thereof. The outer cap 9 is then placed over the inner cap 1, such that the retainer thread segments 10 engage the respective wall grooves 5 and the outer cap 9 is then twisted in the clockwise direction to tightly secure the outer cap 9 to the inner cap 1 and press the wall shoulder 14 tightly against the seal 7, to seal the seal space 8. Accordingly, when it is desired to remove the inner cap 1 from the threaded neck of the container, the outer cap 9 must be grasped, since the outer wall cap 11 extends beyond the hidden inner cap wall 3. When the outer cap 9 is initally twisted in the counterclockwise direction, the outer cap 9 first loosens on the inner cap 1 as the retainer thread segments 10 traverse the wall grooves 5, to break the seal in the seal space 8. When the retainer thread segments 10 engage the opposite ends of the wall grooves 5 at maximum travel, then additional counterclockwise pressure on the outer cap 9 causes the inner cap 1 to rotate and unthread on the container neck and allows air to traverse the neck threads 2 and enter the container. This action breaks the seal in the container, eliminates the vacuum therein and causes the diaphragm 6 to move upwardly to a neutral position in close proximity to the transparent outer cap window 13, such that the diaphragm 6 can be viewed through the transparent outer cap window 13, to determine that the seal in the container has been broken. This container tamper detection mode is particularly useful when the container for the drugs or medicine is constructed of a plastic material which can be penetrated by a device such as a hypodermic needle, to inject a contaminant. Any such puncture will result in loss of vacuum in the container, with resulting return of the diaphragm to the neutral position, to indicate tampering.

In an alternative sealing embodiment of the invention, the inner cap 1 may be threaded on the neck of the container and a pressure greater than atmospheric pressure applied to the container and the inner cap, to deflect the diaphragm 6 inwardly from a neutral position. The outer cap 9 is then secured to the inner cap 1 as described above, while the positive pressure is still applied to the system. This action seals the pressurized seal space 8 between the inner cap 1 and the outer cap 9 and the diaphragm will return to the neutral position if the outer cap 9 is loosened on the inner cap 1. This alternative cap tamper detection mode is primarily useful under circumstances where the container for the drugs or medicine is constructed of glass or a high impact plastic material which cannot be effectively penetrated by a hypodermic needle or other device to inject contaminants into the container itself. Alternatively, the positive pressure can be applied to the outer cap 9 and the inner cap 1 while the outer cap 9 is loosely mounted on the inner cap 1, to depress the diaphragm 6. The outer cap 1 is then tightened on the inner cap 1 while under pressure, in order to seal the pressurized seal space 8. The inner cap 1 can then be tightened on the container by grasping the outer cap 9, as above described.

In a most preferred embodiment of the invention, the top of the diaphragm 6 is tinted with a color such as red, which can be easily viewed through the transparent outer cap window 13, in order to more easily determine whether the diaphragm 6 has deflected to a neutral position from the position illustrated in FIG. 2, pursuant to either of the tamper detection modes described above. Furthermore, it will be appreciated by those skilled in the art that the diaphragm 6, located in the inner cap 1, can be constructed of rubber or an elastomeric, thermoplastic or thermoresin material of suitable thickness and flexibility to facilitate deformation under pressure according to the described tamper detection modes.

While the preferred embodiments of the invention have been described above, it will be recognized and understood that various modifications may be made therein and the appended claims are intended to cover all such modifications which may fall within the spirit and scope of the invention.

Having described my invention with the particularly set forth above, what is claimed is:

1. A tamper detection cap for attachment to a container having a threaded neck, comprising an inner cap provided with internal threads for threadibly engaging the threaded neck of the container; a flexible diaphragm spanning the top of said inner cap, said diaphragm adapted to flex inwardly of said inner cap into a curvature after said inner cap is threadibly tightened on the threaded neck responsive to a pressure differential across said diaphragm; at least two grooves provided in said inner cap; an outer cap adapted to enclose said inner cap and a substantially transparent window provided in said outer cap for viewing said diaphragm; and at least two retainer thread segments projecting inwardly from said outer cap in facing, skewed relationship with respect to said window, said retainer thread segments adapted for engaging said grooves, respectively, in said inner cap when said outer cap is secured to said inner cap, whereby detection of a change in said curvature of said diaphragm responsive to counterclockwise rotation of said outer cap and said inner cap and loosening of said inner cap on the threaded neck of the container is facilitated by observing said diaphragm through said transparent window.

2. The tamper detection cap of claim 1 wherein said curvature of said diaphragm is convex and said grooves are longer than said retainer thread segments, whereby said outer cap can be loosened with respect to said inner cap throughout a limited range of motion of said retainer thread segments in said grooves without loosening said inner cap on the threaded neck of the container, to eliminate said curvature in said diaphragm.

3. The tamper detection cap of claim 1 further comprising seal means encircling said diaphragm in said inner cap, for sealing the space between said inner cap and said outer cap when said outer cap is tightened on said inner cap.

4. The tamper detection cap of claim 1 wherein said curvature of said diaphragm is convex and said grooves are longer than said retainer thread segments, whereby said outer cap can be loosened with respect to said inner cap throughout a limited range of motion of said retainer thread segments in said grooves without loosening said inner cap on the threaded neck of the container, to eliminate said curvature in said diaphragm and further comprising seal means encircling said diaphragm in said inner cap for sealing the space between said inner cap and said outer cap when said outer cap is tightened on said inner cap.

5. The tamper detection cap of claim 1 wherein the top of said diaphragm is tinted with a selected color for enhanced viewing of said diaphragm through said transparent window when said outer cap is mounted on said inner cap.

6. The tamper detection cap of claim 5 wherein said curvature of said diaphragm is convex and said grooves are longer than said retainer thread segments, whereby said outer cap can be loosened with respect to said inner cap throughout a limited range of motion of said retainer thread segments in said grooves without loosening said inner cap on the threaded neck of the container, to eliminate said curvature in said diaphragm.

7. The tamper detector cap of claim 5 further comprising seal means encircling said diaphragm is said inner cap, for sealing the space between said inner cap and said outer cap when said outer cap is tightened on said inner cap.

8. The tamper detection cap of claim 5 wherein said curvature of said diaphragm is convex and said grooves are longer than said retainer thread segments, whereby said outer cap can be loosened with respect to said inner cap throughout a limited range of motion of said retainer thread segments in said grooves without loosening said inner cap on the threaded neck of the container, to eliminate said curvature in said diaphragm and further comprising seal means encircling said diaphragm in said inner cap, for sealing the space between said inner cap and said outer cap when said outer cap is tightened on said inner cap.

9. A tamper detection cap for attachment to a container having a threaded neck, comprising a cylindrical inner cap provided with internal threads for threadibly engaging the threaded neck of the container; a flexible diaphragm spanning the top of said inner cap, said diaphragm adapted to flex inwardly of said inner cap when said inner cap is threadibly tightened on the threaded neck responsive to a pressure differential across said diaphragm; a plurality of grooves provided in said inner cap in spaced, skewed relationship; a cylindrical outer cap adapted to enclose said inner cap and a substantially transparent window provided in the top of said outer cap for viewing said diaphragm; and a plurality of retainer thread segments projecting inwardly from said outer cap in facing, skewed relationship, said retainer thread segments adapted for engaging said grooves, respectively, in said inner cap when said outer cap is secured to said inner cap, for removing a vacuum in the container and causing said diaphragm to assume a neutral configuration responsive to counterclockwise rotation of said outer cap and loosening of said inner cap on the threaded neck of the container to facilitate entry of air into the container.

10. The tamper detection cap of claim 9 further comprising seal means encircling said diaphragm in said inner cap, for sealing the space between said inner cap and said outer cap when said outer cap is tightened on said inner cap.

11. The tamper detection cap of claim 9 wherein the top of said diaphragm is tinted with a selected color for enhanced viewing of said diaphragm through said transparent window when said outer cap is mounted on said inner cap.

12. A tamper detection cap for attachment to a container having a threaded neck, comprising an inner cap provided with a cylindrical side wall having internal threads for threadibly engaging the threaded neck of the container; an elastomeric diaphragm spanning the top of said inner cap, said diaphragm adapted to flex outwardly of said inner cap in convex relationship when said inner cap is threadibly tightened on the threaded neck responsive to a pressure differential across said diaphragm; a plurality of grooves provided in said side walls of said inner cap in spaced, skewed relationship with respect to a plane extending through the top of said inner cap; a cylindrical outer cap adapted to enclose said inner cap and a substantially transparent window provided in the top of said outer cap for viewing said diaphragm; and a plurality of retainer thread segments projecting inwardly from said outer cap in facing, skewed relationship with respect to said window, said retainer thread segments adapted for engaging said grooves, respectively, in said inner cap when said outer cap is secured to said inner cap, whereby detection of a change in said curvature of said diaphragm responsive to counterclockwise rotation of said outer cap and loosening of said outer cap on said inner cap is facilitated by observing said diaphragm through said transparent window.

13. The tamper detection cap of claim 12 wherein said grooves are longer than said retainer thread segments, whereby said outer cap can be loosened with respect to said inner cap throughout a limited range of motion of said retainer thread segments in said grooves without loosening said inner cap on the threaded neck of the container.

14. The tamper detection cap of claim 12 further comprising seal means encircling said diaphragm in said inner cap, for sealing the space between said inner cap and said outer cap when said outer cap is tightened on said inner cap.

15. The tamper detection cap of claim 12 wherein said grooves are longer than said retainer thread segments, whereby said outer cap can be loosened with respect to said inner cap throughout a limited range of motion of said retainer thread segments in said grooves without loosening said inner cap on the threaded neck of the container and further comprising seal means encircling said diaphragm in said inner cap, for sealing the space between said inner cap and said outer cap when said outer cap is tightened on said inner cap.

16. The tamper detection cap of claim 12 wherein the top of said diaphragm is tinted with a selected color for enhanced viewing of said diaphragm through said transparent window when said outer cap is mounted on said inner cap.

17. The tamper detection cap of claim 16 wherein said grooves are longer than said retainer thread segments, whereby said outer cap can be loosened with respect to said inner cap throughout a limited range of motion of said retainer thread segments in said grooves without loosening said inner cap on the threaded neck of the container and further comprising seal means encircling said diaphragm in said inner cap, for sealing the space between said inner cap and said outer cap when said outer cap is tightened on said inner cap.

* * * * *